United States Patent [19]

Puri et al.

[11] Patent Number: 4,662,443

[45] Date of Patent: May 5, 1987

[54] COMBINATION AIR-BLOWN AND OXYGEN-BLOWN UNDERGROUND COAL GASIFICATION PROCESS

[75] Inventors: Rajen Puri; Luis E. Arri; Bruce W. Gash, all of Tulsa, Okla.

[73] Assignee: Amoco Corporation, Chicago, Ill.

[21] Appl. No.: 806,054

[22] Filed: Dec. 5, 1985

[51] Int. Cl.[4] ..... C10B 57/20

[52] U.S. Cl. ..... 166/261; 166/251; 48/210

[58] Field of Search ..... 166/261, 256, 251, 245; 48/210, DIG. 6

[56] References Cited

U.S. PATENT DOCUMENTS

| | | | |
|---|---|---|---|
| 3,044,545 | 7/1962 | Tooke | 166/261 X |
| 3,237,689 | 3/1966 | Justheim | 166/247 X |
| 3,892,270 | 7/1975 | Lindquist | 166/261 X |
| 4,087,130 | 5/1978 | Garrett | 166/261 X |
| 4,089,372 | 5/1978 | Terry | 166/261 X |
| 4,099,567 | 7/1978 | Terry | 166/261 |
| 4,114,688 | 9/1978 | Terry | 166/261 X |
| 4,185,692 | 1/1980 | Terry | 166/261 X |
| 4,243,101 | 1/1981 | Grupping | 166/261 |
| 4,356,866 | 11/1982 | Savins | 166/261 |
| 4,476,927 | 10/1984 | Riggs | 166/261 |

*Primary Examiner*—Stephen J. Novosad

*Attorney, Agent, or Firm*—F. E. Hook; R. R. Cochran; T. H. Briggs

[57] ABSTRACT

Use of an air-blown underground coal gasification plant to produce low-Btu gas thereby providing boiler fuel needed for an oxygen-blown underground coal gasification plant. The product from the oxygen-blown plant can be used for the production of synthetic natural gas or other uses. A preferred production gasification is also shown.

8 Claims, 2 Drawing Figures

COMBINATION AIR-BLOWN AND OXYGEN-BLOWN UNDERGROUND COAL GASIFICATION PROCESS

BACKGROUND OF THE INVENTION

1. Field of the Invention

The Department of Energy has estimated that about 1.8 trillion tons of now unrecoverable domestic coal could be exploited to produce gaseous and/or liquid fuels via underground coal gasification (UCG). This 1.8 trillion ton resource involves coal that is too deep, too steeply dipping, or of marginal quality for economic recovery by mining. Accordingly, UCG has enormous potential for providing a long-term gaseous and/or liquid fuel supply and may be the only economic method of recovering existing unminable domestic coal resources.

The chemistry of underground, or in-situ, coal gasification is similar to that observed in the surface gasification of coal, a process developed by Lurgi and others. The coal is reacted in the underground coal seam using an oxidant such as oxygen and steam to produce hydrogen, carbon monoxide, methane, carbon dioxide, and small concentrations of some other compounds. These gases are piped to a surface facility where the reactive species are converted to synthetic natural gas (SNG) (methane) and/or liquid fuels such as methanol, gasoline, or diesel fuel. Partial oxidation of the coal supplies the heat necessary to develop temperatures of 1800°–2200° F. required to drive the endothermic gasification reactions.

To date, application of UCG to recover coal resources on a semicommercial or commercial scale has been practiced only in the U.S.S.R., the study of which began as early as 1927. This work continued on air-blown underground coal UCG with the intent of producing low-Btu gas for industrial fuel and generation of electricity.

As in surface gasification, the use of steam and oxygen is a prerequisite for economically producing SNG and/or liquid fuels. Tests conducted in this country have demonstrated the feasibility of oxygen-blown gasification of coal in both flat-lying and steeply dipping seams. The gas gathered in such a system consists principally of hydrogen, carbon monoxide, carbon dioxide, water vapor, and methane. Minor constituents include hydrogen sulfide, ammonia, and entrained particles carried by the gas stream. This gas mixture is treated in a surface plant to remove and separate the methane, particulates, carbon dioxide, hydrogen sulfide, ammonia, and tars producing a gas consisting primarily of carbon monoxide, and hydrogen. This latter gas, sometimes called synthesis gas, can be piped to a central gas processing plant for conversion to SNG or liquid fuels. Processing steps include: (1) quench and scrubbing, (2) compression and shift, (3) acid gas removal and sulfur recovery, and (4) conversion.

2. Related Art

The Lurgi process has been mentioned. The drawing of a typical gasifier for this process is shown on page 206 of "*Synthetic Fuels Data Handbook,*" compiled by Dr. Thomas A. Hendrickson, copyright 1975, by Cameron Engineers, Inc. The next page of this publication discloses that El Paso Natural Gas Company has proposed the use of Lurgi gasifiers for the Burnham Coal Gasification Complex to be located near Farmington, New Mexico. In this plant, gasifiers are shown in two applications. One group of gasifiers is oxygen blown and produces a relatively high methane content gas which is upgraded to pipeline gas quality. In the second application, air-blown Lurgi gasifiers produce low-Btu gas for in-plant use to generate process steam and electric power.

The coal gasification steps produce, as the output of the Lurgi gasifier, either a medium-Btu or a low-Btu content stream. The terms "low," "medium," and "high," are not specific defined limits. However, low Btu is generally considered to contain less than 200 Btu/SCF, medium-Btu gas would contain 200 to 400 Btu/SCF. All these values are based on dry gas.

SUMMARY OF THE INVENTION

Broadly, the invention resides in a method of underground coal gasification in a coal seam between linked injection and production wells comprising igniting coal located between said wells, injecting steam and oxygen to maintain combustion between said wells thereby forming a medium-Btu gas, the Btu content of said gas gradually decreasing, switching to air injection to said seam when the Btu content had reached a predetermined point, thereby continuing combustion with a production of a low-Btu content gas suitable for consumption at said seam for the production of utilities required at said seam.

The exact point at which the seam is switched from oxygen to air blowing depends upon the particular conditions. Generally, as stated, a medium-Btu gas is considered to have a heating value of 200 to 400 Btu/SCF. Therefore, said switching of injection streams can occur at a point when the Btu content of the medium-Btu gas approaches 200 Btu/SCF.

This system can proceed across a seam by a combination of the two blowing systems. Specifically, the oxygen and steam injection can be initiated in an adjacent well pair in said seam followed by switching of the first well pair to air injection.

Preferably, the system is designed with a preferred coal burning system. When the coal is generally horizontal and wherein the loose coal has a known angle of repose, the process comprises providing said injection well positioned at an angle with respect to a horizontal of less than the angle repose and said production well is positioned at an angle with regard to the horizontal of the angle of repose but less than 90°, and wherein the distance between the wells decreases toward the bottom of the seam. Such wells can be drilled to be intersecting or they can be drilled to a point nearly intersecting and linked by reverse combustion.

Stated another way, this invention provides a method of underground coal combustion for the generation of medium-Btu gas suitable for the production of SNG or liquid fuel comprising gasifying coal in a first zone in a coal seam by air blowing, thereby producing a low-Btu gas, feeding said gas to a boiler thereby generating steam, utilizing a portion of said steam as hereinafter recited and the balance for electrical power generation, gasifying coal in a second zone of said seam by blowing the same with a mixture of steam generated in said boiler and oxygen thereby producing a medium-Btu gas, switching to air blowing in said second zone when the Btu content of the gas produced falls below a predetermined value, and beginning steam and oxygen feed to a third zone in said seam and repeating the steps in successive zones in said seam.

In these processes, the low-Btu gas may have to be cleaned up to provide a suitable boiler fuel, but in other instances, the gas can be used directly.

The medium-Btu gas can be converted to synthetic natural gas or liquid fuels by known operations.

Reduced capital cost is a major advantage of this system. The cost of generating the low-Btu gas is similar to the cost of buying the needed amount of mined coal. However, the cost of gas fired furnaces is about one quarter the cost of a coal fired furnace.

PREFERRED EMBODIMENT

Figure 1:
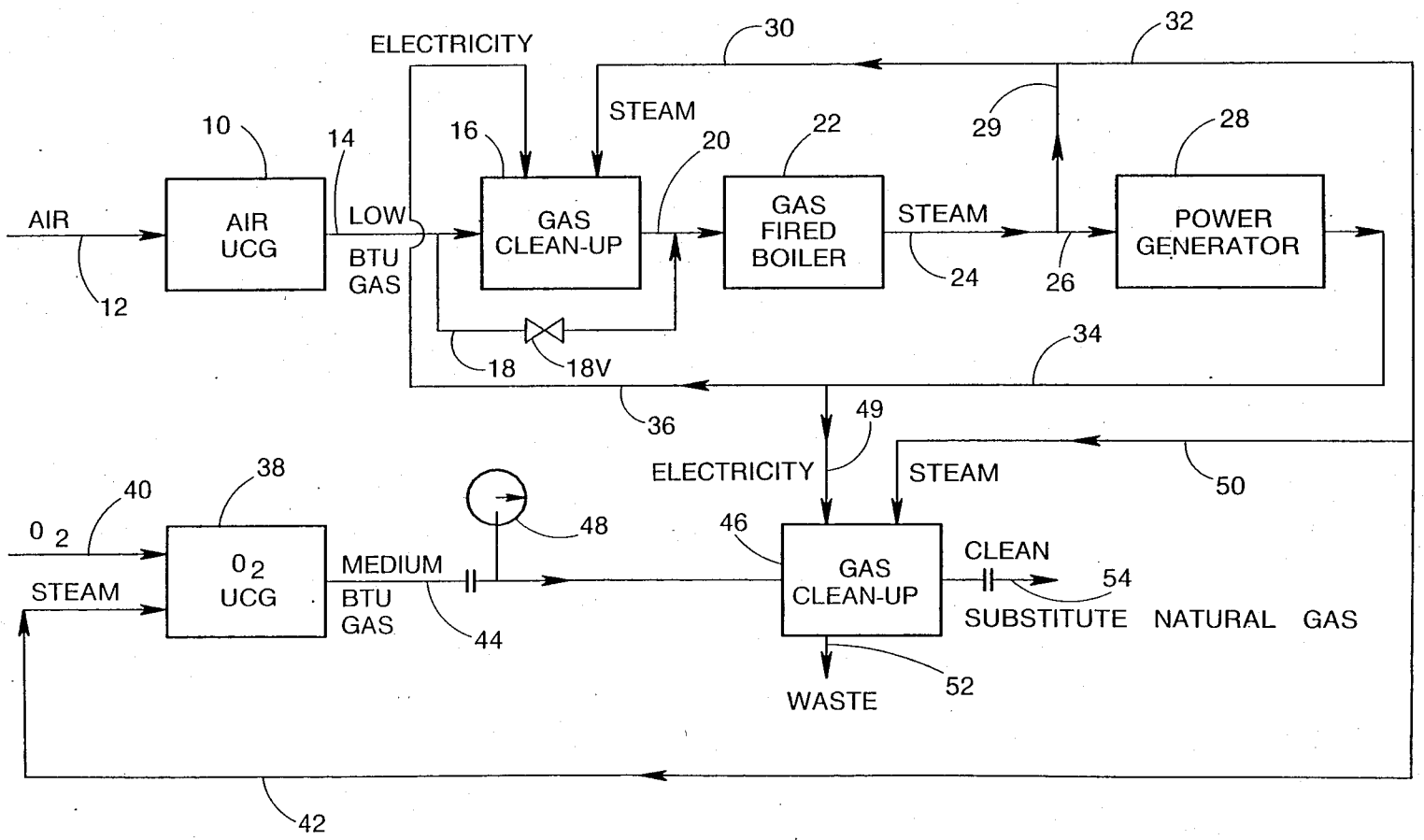
FIG. 1 showing a schematic diagram illustrating the invention.

Directing attention to FIG. 1, the drawing illustrates the combination of the present invention. The upper portion of the drawing shows elements required for air-blown UCG while the lower portion illustrates the oxygen-blown UCG system. Specifically, an air-blown UCG cavity 10 is shown supplied by air through conduit 12. Obviously, other oxidants known in the art could be used. As is known, this produces a low-Btu gas product which is passed by conduit 14 to a gas cleanup system 16. A bypass conduit 18 having valve 18V therein extends around gas cleanup system 16 and is used when the low-Btu gas can be burned directly. After cleanup, if used, the gas passes by conduit 20 to a gas-fired boiler 22 wherein steam is generated. This steam is removed in conduit 24 with a portion passing by conduit 26 to electrical power generator 28 and a portion passing by conduits 29 and 30 to the gas cleanup system 16. A further portion is removed in conduit 32 for use as hereinafter specified. Electrical power is obtained in conduit 34 with a portion of this passing by conduit 36 to gas cleanup system 16, if necessary.

In the lower portion of the FIG. 1, an oxygen-blown UCG cavity is shown as 38. This is supplied with oxygen from an oxygen plant (not shown) by conduit 40, and a portion of the steam in conduit 32 is passed by conduit 42 to this cavity. As is well known, oxygen-blown UCG processes produce a medium-Btu gas which is removed by conduit 44 and passed to gas cleanup system 46. Means are provided such as a gas chromatographic analyzer or calorimeter 48 to measure the Btu content of the medium gas in conduit 44. Gas cleanup system 46 receives electricity from conduit 34 by means of conduit 49 and steam by conduit 50 from conduit 32. Waste products are removed by conduit 52, and the clean gas which can be converted to substitute natural gas removed by conduit 54.

Figure 2:
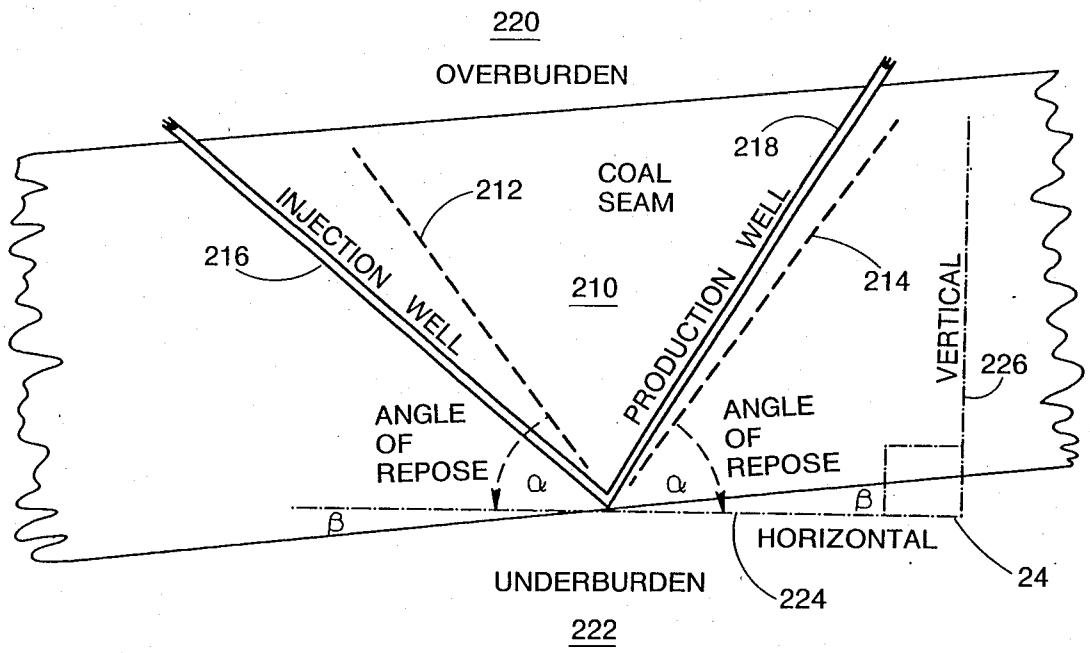
FIG. 2 illustrating a preferred method of producing the coal seam.

While this system can be used with noninteracting cavities of the type known in the art, a preferred method of production is shown in FIG. 2. In FIG. 2, a coal seam, which is generally horizontal is designated as 210 which is "thick," i.e., having a thickness in the range of 30 to 100 ft. The angle of repose of loose coal and char is designated by the dashed lines 212 and 214. The angle of repose is shown as $\alpha$. This coal seam should be generally horizontal, which has an incline of not more than 20° designated as $\beta$ on this figure. These angles are measured with respect to the horizontal 24. True vertical is line 226. Production from the coal seam is obtained by drilling an injection well 216 (into which the oxidant will be injected) to intersect or nearly intersect the production well 218 near the bottom of the coal seam. If these wells do not intersect, they can be linked by reverse combustion. In a coal seam, the injection well is drilled at an angle less than the angle of repose. This will prevent damage to the injection well which might result from subsidence. The production well 218 is drilled at an angle greater than the angle of repose because the coal slumps and falls to the bottom of the production well where it is gasified. These wells can be drilled at any angle through the overburden 220 and deviated through the coal seam 210 at the desired angle to a point of the top near the underburden 222. The production well 218 is preferably cased through the overburden and completed openhole in the coal seam. The injection well is preferably completely cased. However, a portion of the injection well 216 in the coal seam can be completed in such a way as to permit controlled retracting injection point maneuvers as disclosed in the CRIP process practiced by Lawrence Livermore National Laboratories. In this system, the cavities are not linked to one another below the ground and each module is individually valved to production pipelines (not shown).

With this well configuration, oxygen utilization can approach that of Lurgi surface coal gasifiers in that the operation is similar to such packed bed reactors. Oxygen utilization is, of course, the number of moles of synthesis gas (carbon monoxide and hydrogen) produced per mole of oxygen injected. This parameter is important in UCG economics since oxygen and steam associated with injection comprised about 40% of the investment cost of the facility.

While the invention has been described with a certain degree of particularity, it is to be understood that the present disclosure has been made by way of example and that changes in details can be made without departing from the spirit thereof.

We claim:

1. A method of underground coal gasification in a coal seam between linked injection and production wells comprising igniting coal located between said wells, injecting steam and oxygen into said coal seam through said injection well to maintain combustion between said wells thereby producing a medium-Btu gas, the Btu content of said gas gradually decreasing, switching to air injection into said coal seam through said injection well when the Btu content has reached a predetermined point thereby continuing combustion with the production of a low-Btu content gas suitable for consumption at facilities located on the surface in the vicinity of said seam for the production of utilities required at said seam.

2. The method of claim 1 wherein said medium-Btu gas has a heating value of 200 to 400 Btu/SCF based on dry gas.

3. The method of claim 1 wherein said switching from steam and oxygen injection to air injection occurs at the point that the Btu content of the medium-Btu gas approaches 200 Btu/SCF based on dry gas.

4. The method of claim 1 wherein said coal seam is generally horizontal and wherein loose coal has a known angle of repose composing providing said injection well positioned at an angle with respect to the horizontal of less than the angle of repose and said production well positioned at an angle with respect to the horizontal of greater than the angle of repose but less than 90°, the distance between said wells decreasing toward the bottom of said seam.

5. The method of claim 1 wherein oxygen and steam oxygen is initiated in an adjacent set of linked injection and production wells in said seam and the process is repeated across said seam.

6. A method of underground coal combustion for the generation of a medium-Btu gas suitable for the production of synthetic natural gas comprising gasifying coal in a first zone in a coal seam by air blowing thereby producing a low-Btu gas, feeding said gas to a boiler located on the surface in the vicinity of said coal seam thereby generating steam, utilizing a portion of said steam as hereinafter recited and the balance for electrical power generation, gasifying coal in a second zone of said seam with a mixture of steam generated in said boiler and oxygen thereby producing a medium-Btu gas, switching to air blowing said second zone when the Btu content of the gas produced falls below a predetermined value and beginning steam and oxygen feed to a third zone in said seam, and repeating the steps in successive zones in said seam.

7. The process of claim 6 wherein said low-Btu gas is cleaned up sufficiently to provide a suitable boiler feed.

8. The process of claim 6 wherein said medium-Btu gas is converted to synthetic natural gas.

* * * * *